US005353676A

United States Patent [19]

King et al.

[11] Patent Number: 5,353,676

[45] Date of Patent: Oct. 11, 1994

[54] APPARATUS AND METHOD FOR REMOTE DISASSEMBLY OF FAILED HIGH EXPLOSIVE TYPE MINE

[75] Inventors: Michael E. King, Madison; Scott D. Spencer, Scottsburg; Marvin C. Eades, Madison, all of Ind.; Ronald A. Jasper, Yuma, Ariz.; Gabe B. Hammond, Madison, Ind.

[73] Assignee: The United States of America as represented by the Secretary of the Army, Washington, D.C.

[21] Appl. No.: 172,794

[22] Filed: Dec. 27, 1993

[51] Int. Cl.[5] ..... F42B 33/00

[52] U.S. Cl. ..... 86/50; 89/1.13; 102/401

[58] Field of Search ..... 86/50, 49; 102/401, 102/293; 89/1.13, 1.11, 1.1

[56] References Cited

U.S. PATENT DOCUMENTS

| | | | |
|---|---|---|---|
| 1,958,420 | 5/1934 | Deck et al. | 86/1 |
| 2,404,441 | 7/1946 | Hopkins | 89/1 |
| 2,491,516 | 12/1949 | Piggot et al. | 86/1.5 |
| 3,109,369 | 11/1963 | Plumley | 102/1 |
| 3,117,518 | 1/1964 | Porter et al. | 102/24 |
| 3,229,561 | 1/1966 | Jones et al. | 86/20 |
| 4,621,562 | 11/1986 | Carr et al. | 89/41.05 |
| 4,779,511 | 10/1988 | Proctor et al. | 86/50 |
| 5,140,891 | 8/1992 | Husseiny et al. | 86/50 |

*Primary Examiner*—J. Woodrow Eldred
*Attorney, Agent, or Firm*—Freda L. Krosnick; Saul Elbaum

[57] ABSTRACT

An apparatus and method for remotely disassembling a failed high explosive type mine. The apparatus is mounted on a mobile chassis and has a remote operator shelter for control of the apparatus. The apparatus has a stripper assembly to remove appendages from the body of the mine. A chuck assembly moves the stripped body of the mine to a cutter assembly and rotates the body of the mine so that the electronics assembly is severed from the body of the mine. A puller assembly extracts the safe and arming device from the high explosive filler in the body of the mine. In an alternate embodiment, a rammer assembly has a pressing cylinder to push the electronics assembly and the safe and arming device from the center of the body of the mine as the outer portion of the body of the mine is firmly retained on the frame of the rammer assembly. Video cameras on the apparatus are provided to permit remote control of the disassembly.

10 Claims, 8 Drawing Sheets

APPARATUS AND METHOD FOR REMOTE DISASSEMBLY OF FAILED HIGH EXPLOSIVE TYPE MINE

The present invention relates to an apparatus and method for remotely disarming a failed high explosive type mine and more particularly, to mechanical means for separating the electronic assembly and the safe and arming device from the high explosive.

BACKGROUND OF THE INVENTION

The disposal and disassembly of failed (dud) high explosive type mines presents a serious safety problem. Since there exist several different designs and configurations for the mines, a correspondingly different disassembly means must be used for the various mines. The applicants are aware of the following U.S. patents which have been directed to deactivating or disposal of munitions or explosive devices:

| Inventor(s) | U.S. Pat. No. |
|---|---|
| Deck et al | 1,958,420 |
| Hopkins | 2,404,441 |
| Piggot et al | 2,491,516 |
| Plumley | 3,109,369 |
| Porter et al | 3,117,518 |
| Jones et al | 3,229,561 |
| Carr et al | 4,621,562 |
| Proctor et al | 4,779,511. |

None of these references have been specifically directed to the family of scatterable mines which have components which differ from the devices disclosed in the references.

The various types of scatterable mines are in the shape of a cylinder approximately five (5) inches in diameter and three (3) inches high. Of the two basic mine configurations, the first has a plastic aeroballistic housing surrounding the metal mine body circumference giving an overall box shape with approximate dimensions of five (5) by six (6) by three (3) inches. The second configuration has metal spring fingers which surround the circumference. Within the mine body there is a safe and arming device located near the center and a potted electronic assembly near the cylinder top. The safe and arming device and the electronics must be separated from the high explosive filler and other components of the mine for safe and complete failure analysis.

SUMMARY OF THE INVENTION

It is an object of the present invention to provide an apparatus and a method for remotely and safely separating the safe and arming device and the electronic assembly from the high explosive filler in a scatterable mine.

It is a further object to provide an apparatus and method which operates remotely to strip appendages from the mine, cut the electronic assembly from the body of the mine and pull the safe and arming device from the mine.

It is still another object of the present invention to provide an apparatus and method which operates remotely to press the safe and arming device and the electronic assembly from the mine and to leave the high explosive filler in the body of the mine.

In accordance with the teachings of the present invention, there is disclosed herein an apparatus for remotely disassembling a failed high explosive type mine having a body, a safe and arming device, an electronic assembly and a high explosive filler. The body of the mine has an outer portion, and an appendage connected to the outer portion of the body of the mine. The apparatus includes a stripper assembly having a tube mounted therein. The tube has a cross section to receive therein the mine with the appendage. The tube has a wall. The wall has a circular opening therein; the circular opening having a diameter to receive therein the body of the mine. A movable cylinder is disposed transversely to the tube and opposite to the opening in the wall of the tube. In this manner, the movable cylinder may press the body of the mine through the circular opening in the wall of the tube and strip the appendage from the outer portion of the body of the mine. A chuck assembly having chuck jaws is provided to receive the body of the mine after the mine has passed through the stripper assembly. The chuck assembly has means therein to move the chuck jaws from a first position adjacent to the stripper assembly to a second position removed from the stripper assembly and adjacent to a cutter assembly. The chuck assembly further has means to rotate the chuck jaws holding the body of the mine. The cutter assembly has a cutter blade rotatably mounted thereon. The cutter assembly is movable, wherein the cutter blade may engage the body of the mine as the body of the mine rotates with the chuck jaws. In this manner, the electronics assembly of the mine may be severed from the high explosive in the mine. A puller assembly is disposed adjacent to the second position of the chuck assembly. The puller assembly has a jaw means to grasp the safe and disarming device in the mine after the electronics assembly has been removed. Means are provided for retracting the jaw means holding the safe and disarming device such that the safe and disarming device is separated from the high explosive in the mine. Means are provided for remotely controlling the stripper assembly, the chuck assembly, the cutter assembly and the puller assembly.

In further accordance with the teachings of the present invention, there is disclosed herein an apparatus for remotely disassembling a failed high explosive type mine having a body, a safe and arming device, an electronic assembly and a high explosive filler. The body of the mine has an outer portion and a center inner portion. The apparatus includes a rammer assembly having a frame. A means is connected to the frame to firmly retain the outer portion of the body of the mine. A pressing cylinder is connected to the frame wherein the cylinder is directed to the center inner portion of the body of the mine. The pressing cylinder is slidably movable within the frame. Power means are provided for moving the pressing cylinder against the center inner portion of the body of the mine to force the safe and arming device and the electronic assembly outwardly from the center inner portion of the mine. Means are provided for remotely controlling the movement of the pressing cylinder.

These and other objects of the present invention will become apparent from a reading of the following specification, taken in conjunction with the enclosed drawings.

DESCRIPTION OF THE PREFERRED EMBODIMENTS

Figure 1:
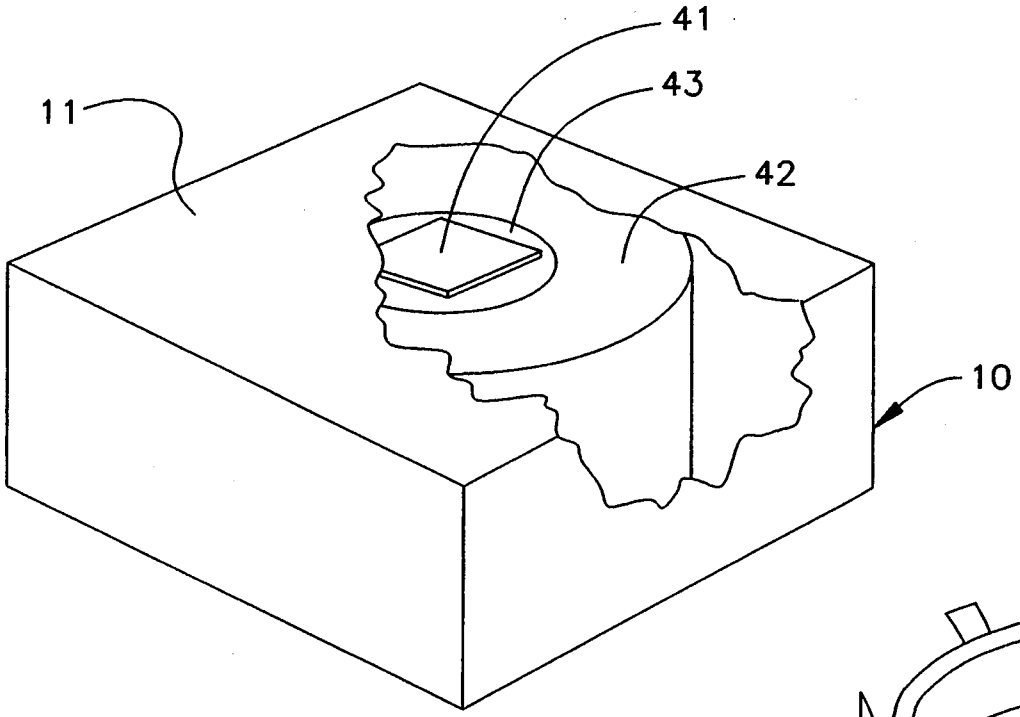
FIG. 1 is a partial cut-away perspective view of a scatterable mine having an aeroballistic housing.
Figure 2:
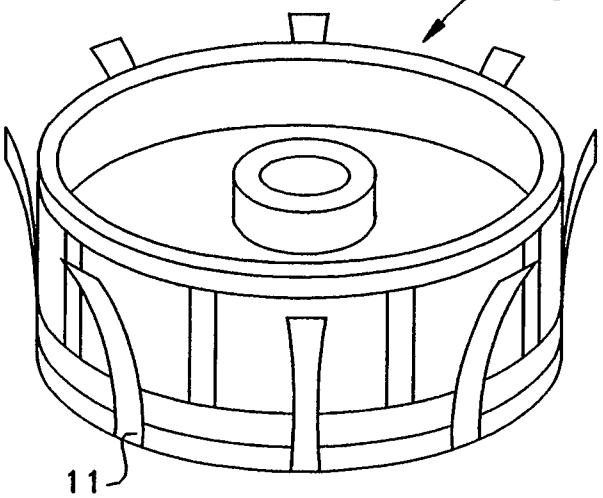
FIG. 2 is a perspective view of a scatterable mine having metal spring fingers about the circumference.

Referring now to FIGS. 1 and 2, the family of scatterable mines is represented by two typical configurations. Substantially, the mines 10 are in the shape of a cylinder approximately five (5) inches in diameter and approximately three (3) inches in height with an appendage 11 attached to the mine body. In one configuration, the appendage 11 is a plastic aeroballistic housing surrounding the outer portion of the metal mine body giving an overall box shape with approximate dimensions of five (5) by six (6) by three (3) inches. The appendage 11 in the second configuration is in the form of metal spring fingers which surround the circumference of the outer portion of the mine body.

Figure 3:
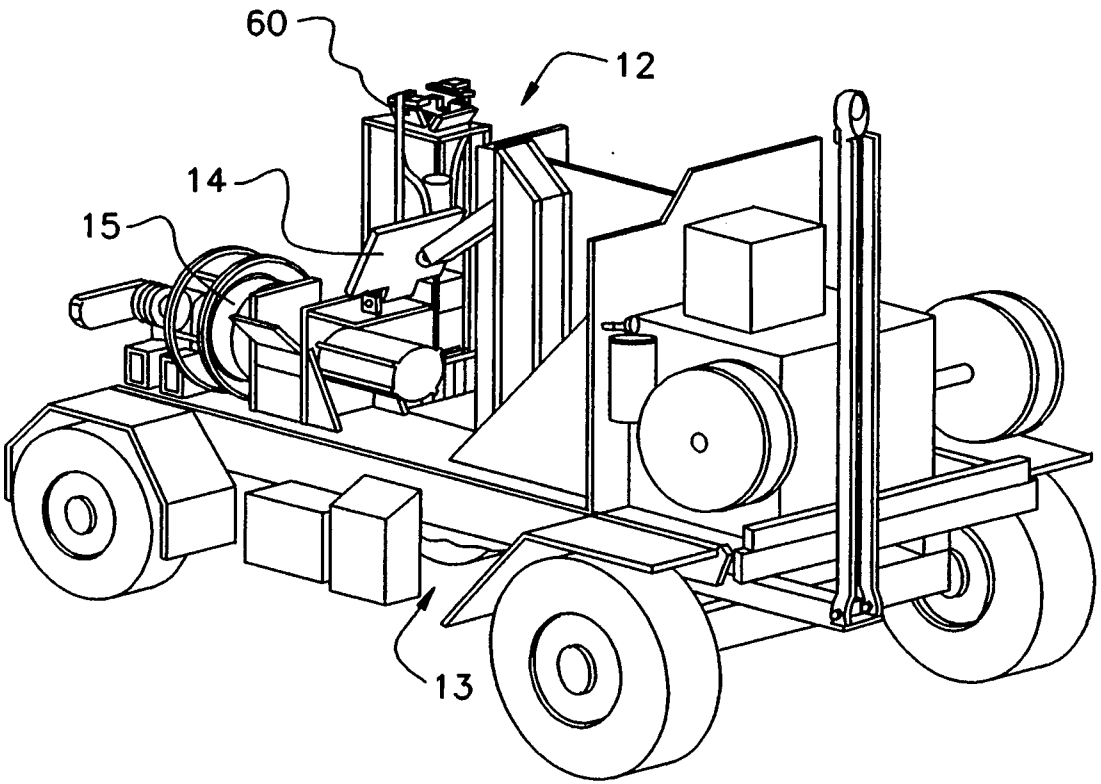
FIG. 3 is a perspective view of the apparatus of the present invention on a mobile chassis.
Figure 4:
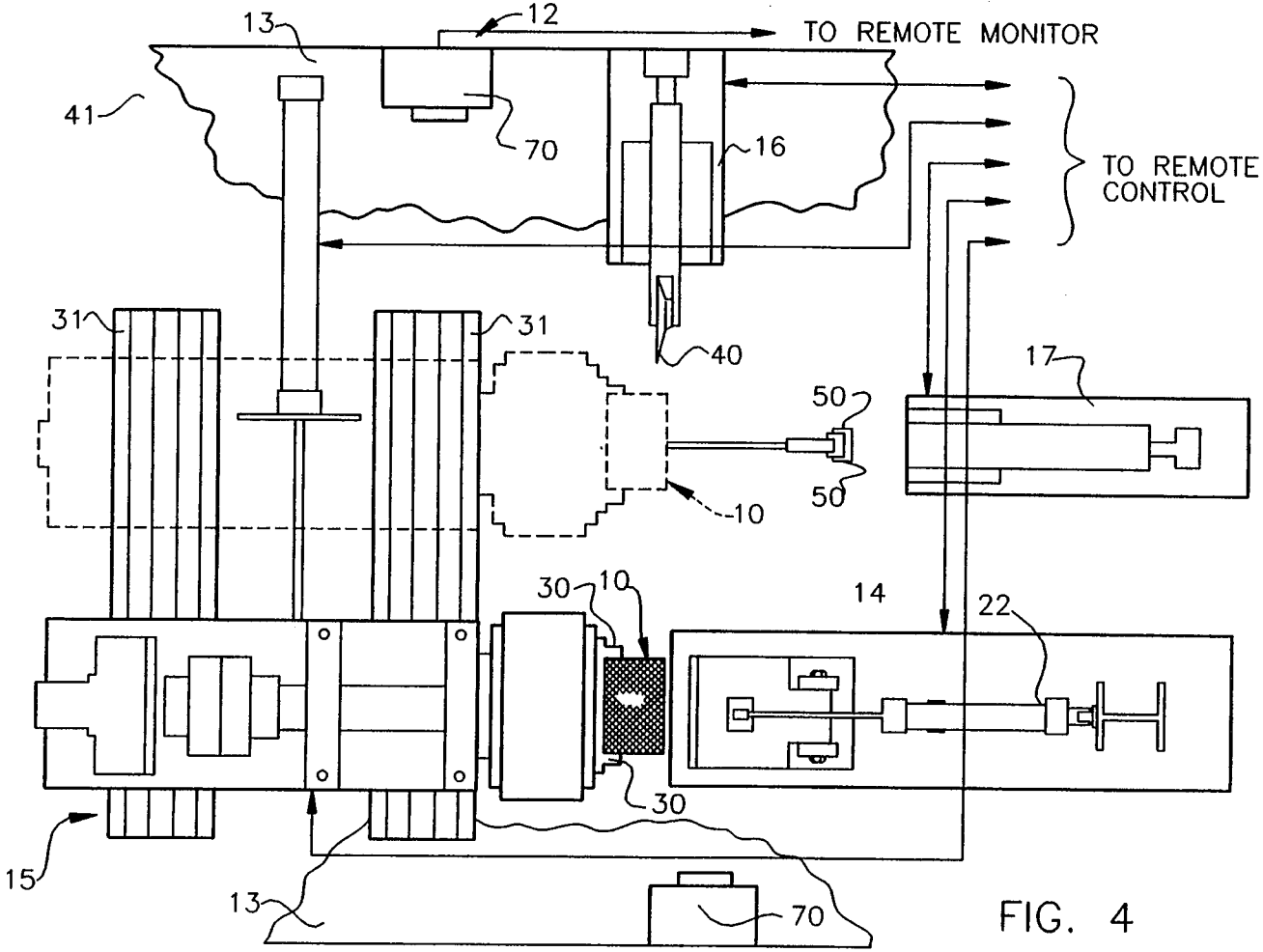
FIG. 4 is a top plan view of the apparatus of the present invention.
Figure 5:
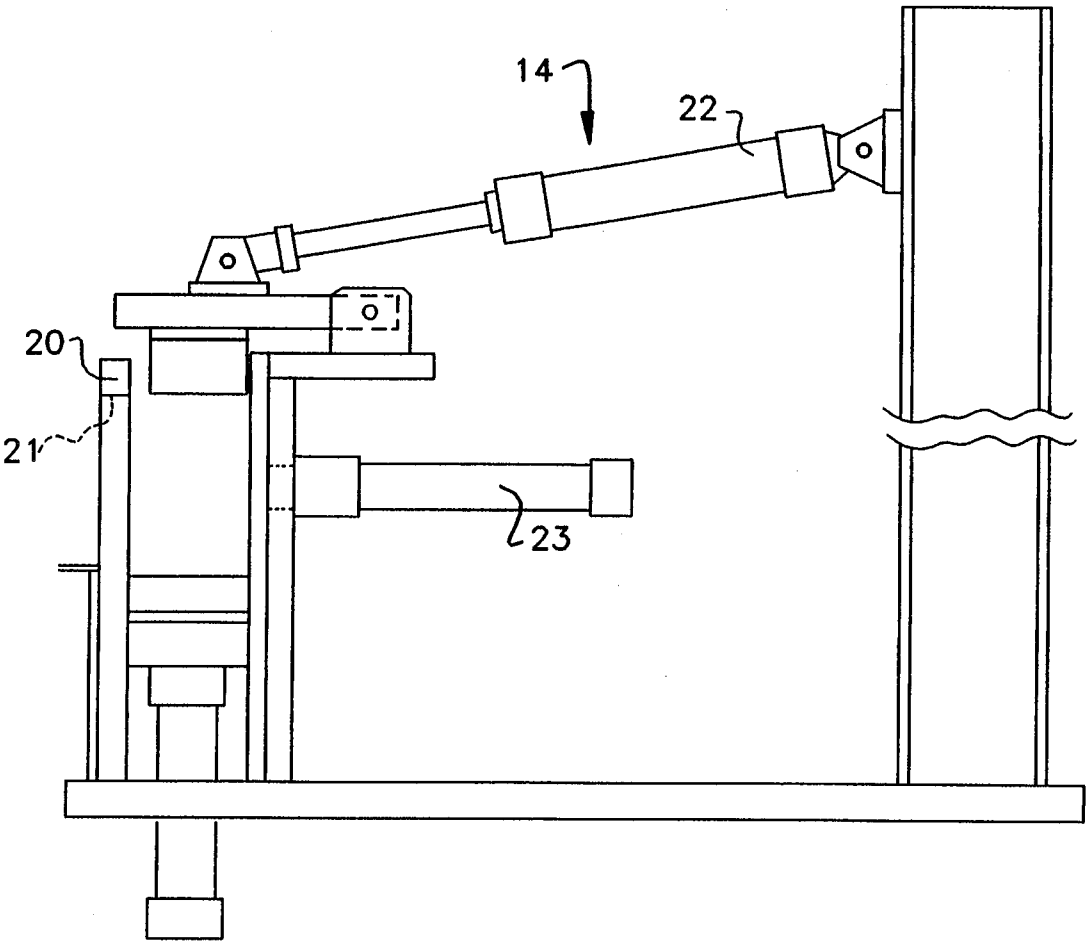
FIG. 5 is a side elevation view of the stripper assembly.
Figure 6:
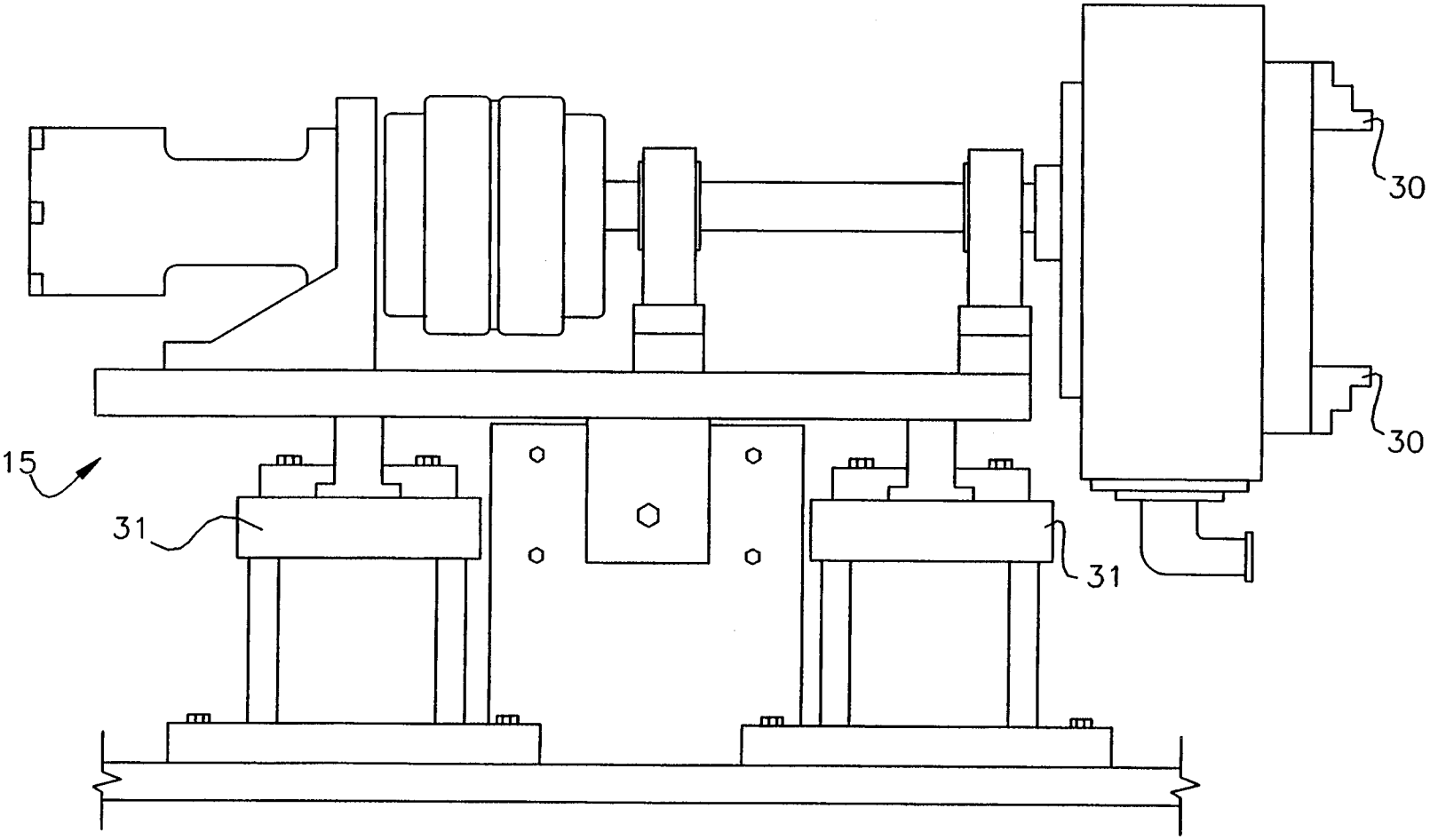
FIG. 6 is a side elevation view of the chuck assembly.
Figure 8:
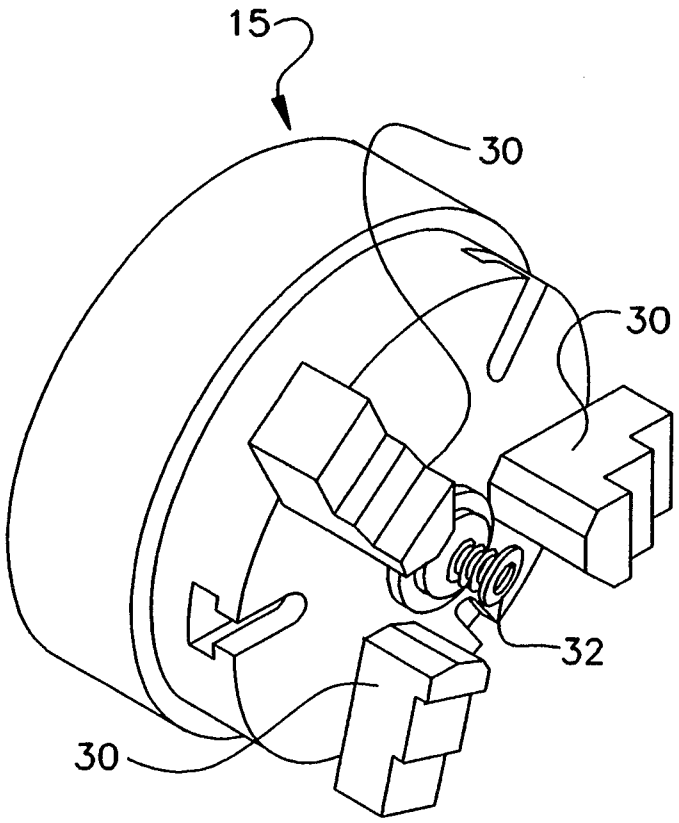
FIG. 8 is a perspective view of the face of the chuck assembly.
Figure 7:
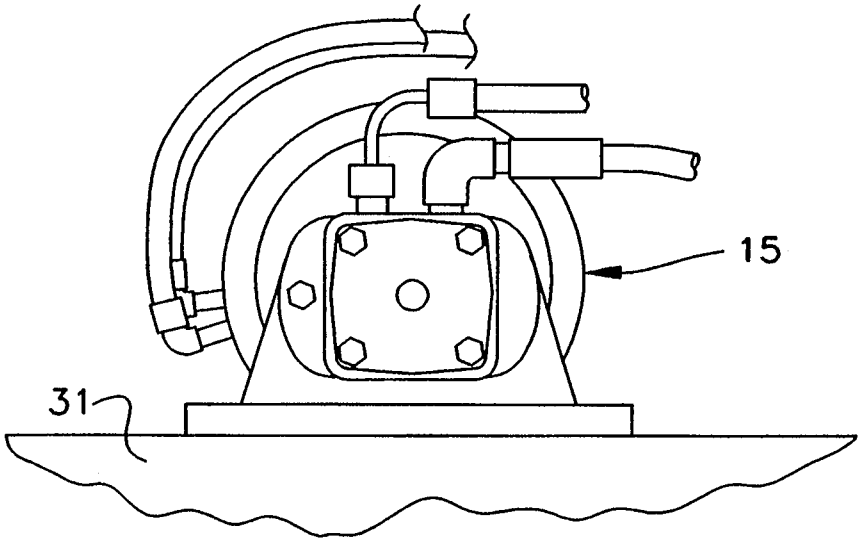
FIG. 7 is an end view of the back of the chuck assembly.
Figures 9, 10:
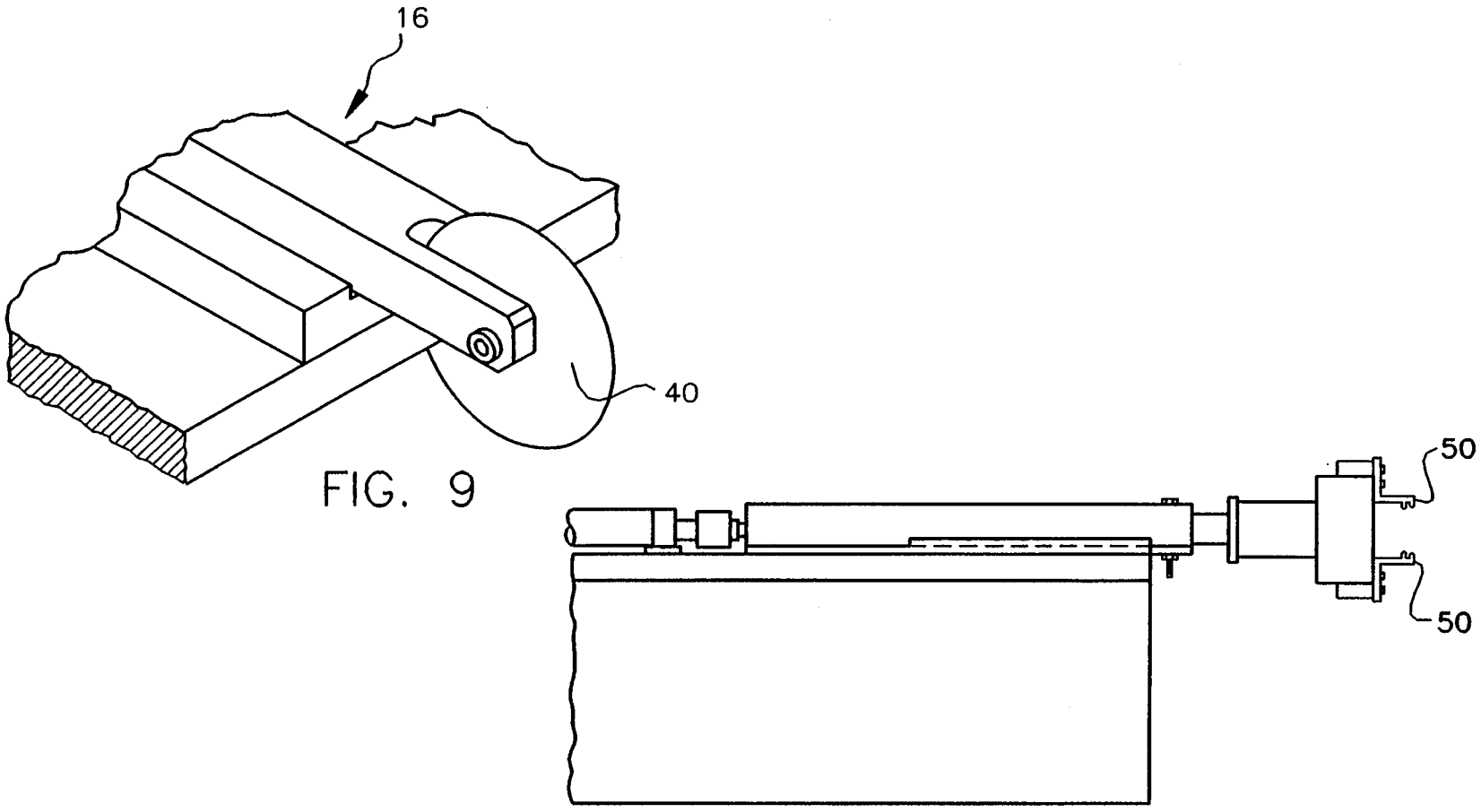
FIG. 9 is a perspective view of the cutter assembly.
FIG. 10 is a side elevation view of the puller assembly.

The apparatus 12 of the present invention is preferably mounted and assembled on a mobile portable trailer chassis 13 which can be placed remotely from persons operating the apparatus to provide safe means for disarming the failed mines 10 (FIG. 3).

Mounted on the mobile portable trailer chassis 13 is a stripper assembly 14, a chuck assembly 15, a cutter assembly 16, and a puller assembly 17 (FIGS. 3–10). The assemblies are disposed on the chassis 13 in a manner wherein the mine 10 may be introduced into the stripper assembly 14 to remove the appendage 11 from the body of the mine 10. The stripped body of the mine 10 is then grasped by the chuck assembly 15 where the mine 10 body is rotated and moved to a second position where the cutter assembly 16 engages the mine 10 body to sever the mine 10 body. The puller assembly 17 then completes the disassembly of the mine 10 as will be described.

The stripper assembly 14 has a tube 20 mounted therein, preferably in a vertical position. The wall of the tube opposite the chuck assembly 15 has a circular opening 21 formed therein. The circular opening has a diameter larger than the body of the mine 10 but smaller than the diameter of the mine 10 with the appendage 11 (FIG. 2 and FIG. 1) thereon. The mine 10 is robotically placed in the tube 20 in a stripping position directly aligned with the circular opening 21. Preferably a cylinder 22 disposes the mine 10 in the stripping position. A movable pressing cylinder 23 is disposed transversely to the tube 20 and opposite to the circular opening 21. The movable cylinder 23 is activated and presses against the body of the mine 10 such that the body of the mine 10 is pushed through the circular opening 21 and the appendage 11 is not pushed through the circular opening 21, but is stripped from the outer portion of the body of the mine 10. Pressure on the mine body 10 is maintained until the body of the mine 10 has passed completely through the circular opening 21 and has been grasped by the chuck assembly 15.

The chuck assembly 15 has chuck jaws 30 on the face of the chuck assembly 15 which are oriented toward the stripper assembly 14. The chuck assembly 15 is mounted on a pair of support guides 31 and is movable from a first position adjacent to the stripper assembly 14 to a second position adjacent to both the cutter assembly 16 and the puller assembly 17 (as shown in broken lines in FIG. 4). The means for moving the chuck assembly 15 may be hydraulic, pneumatic or electric which can be controlled remotely. Further the chuck assembly 15 has means to rotate the chuck jaws 30. The chuck assembly 15 has a stabilizing tension spring 32 mounted on the center of the chuck jaws 30. The tension spring 32 urges the mine body 10 away from direct contact with the face of the chuck assembly 15 and also assists in the proper orientation of the mine 10 so the mine 10 does not tilt in the chuck jaws 30. After the appendage 11 has been removed from the body of the mine 10, the stripped body of the mine 10 is received and securely held in the chuck jaws 30. The chuck jaws 30 holding the body of the mine 10 is moved to the second position and the chuck jaws 30 are caused to rotate.

The cutter assembly 16 has a cutter blade 40 rotatably mounted thereon. The cutter assembly 16 is movable wherein the cutter blade 40 may engage and cut the body of the mine 10 as the body of the mine 10 is rotated in the chuck jaws 30. In this manner, the electronics assembly 41 of the mine 10 may be severed from the portion of the body of the mine in which the high explosive filler 42 is contained. After the electronics assembly 41 has been removed from the body of the mine 10, the cutter assembly 16 is moved to remove the cutter blade 40 from engagement with the body of the mine 10 and the cutter assembly 16 is deactivated. In some instances, the safe and arming device 43 is dislodged from the body of the mine 10 when the electronics assembly 41 is severed. In these instances, the disassembly is complete.

In the instances where the safe and arming device 42 remains in the body of the mine 10 with the high explosive filler 41, the puller assembly 17 is activated. The puller assembly 17 has a jaw means 50 mounted thereon so that the jaw means 50 can be advanced and retracted with respect to the second position of the chuck assembly 15. The chuck jaws 30 holding the severed body of the mine 10 is rotated to a proper orientation with respect to the jaw means 50 on the puller assembly 17. The jaw means 50 grasp the safe and arming device 43 after the body of the mine 10 has been severed by the cutter assembly 16. The jaw means 50 are retracted, pulling the safe and arming device 43 from the high explosive filler in the body of the mine and completing the disassembly of the mine 10.

The apparatus 12 may be reset for insertion of another mine 10 for disassembly.

Figure 11:
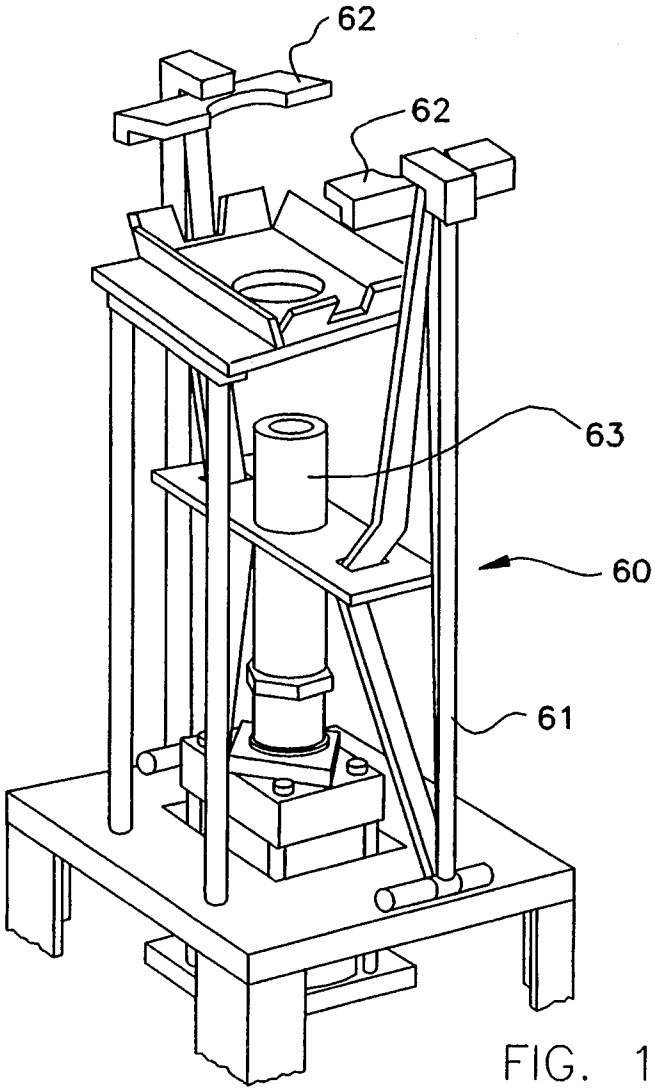
FIG. 11 is a perspective view of the rammer assembly.

In an alternate embodiment, a rammer assembly 60 is mounted on the portable mobile chassis 13, either separately, or in addition to, the above-identified apparatus 12 (FIG. 11).

The rammer assembly 60 has a frame 61 mounted on the chassis 13. Means 62 are connected to the frame 61 to firmly retain the outer portion of the body of the mine 10. The means 62 may be an adjustable clamp or jaws which not only hold the mine 10 but also are disposed over the top edges of the mine 10 to retain the mine 10. A pressing cylinder 63 is connected to the frame 61 in a manner such that the pressing cylinder 63 is directed to the center, inner portion of the body of the mine 10.

The pressing cylinder 63 is slidably movable within the frame 61 and is powered by hydraulic, pneumatic or electrical means. The pressing cylinder 63 is pressed against the center inner portion of the body of the mine 10 such that the electronics assembly 41 and the safe and arming device 43 are pressed outwardly from the body of the mine 10 and the mine is thereby disassembled.

Remote control of the disassembly operations is performed through the use of at least two video cameras 70 mounted near the apparatus and directed toward the mine 10 during the process of disassembly. The output of the video cameras 70 is transmitted to at least one video display screen in a portable operator shelter located remotely from the mobile chassis 13. It is preferred that the operator shelter be at least thirty (30) feet from the disassembly apparatus 12. A control panel is mounted in the operator shelter to enable the operator to activate and deactivate the various assemblies at the proper time by means of hydraulic, pneumatic and/or electrical power.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for remotely disassembling a failed high explosive type mine having a body, a safe and arming device, an electronic assembly and a high explosive filler, the body of the mine having an outer portion, an appendage being connected to the outer portion of the body of the mine, the apparatus comprising:

a stripper assembly having a tube mounted therein, the tube having a cross section to receive therein the mine with the appendage, the tube having a wall having a circular opening therein, the circular opening having a diameter to receive therein the body of the mine, a movable cylinder disposed transversely to the tube and opposite to the opening in the wall of the tube wherein the movable cylinder may press the body of the mine through the circular opening in the wall of the tube to strip the appendage from the outer portion of the body of the mine;

a chuck assembly having chuck jaws to receive the body of the mine after the mine has passed through the stripper assembly, the chuck assembly having means therein to move the chuck jaws from a first position adjacent to the stripper assembly to a second position removed from the stripper assembly and adjacent to a cutter assembly, the chuck assembly further having means to rotate the chuck jaws holding the body of the mine;

the cutter assembly having a cutter blade rotatably mounted thereon, the cutter assembly being movable, wherein the cutter blade may engage the body of the mine as the body of the mine rotates with the chuck jaws, such that the electronics assembly of the mine may be severed from the high explosive in the mine;

a puller assembly disposed adjacent to the second position of the chuck assembly, the puller assembly having a jaw means to grasp the safe and arming device in the mine after removal of the electronics assembly, means for retracting the jaw means holding the safe and disarming device such that the safe and disarming device is separated from the high explosive in the mine;

and means for remotely controlling the stripper assembly, the chuck assembly, the cutter assembly and the puller assembly.

2. The apparatus of claim 1, further comprising a portable chassis on which the apparatus is mounted.

3. The apparatus of claim 1, wherein the appendage is an aeroballistic housing.

4. The apparatus of claim 1, wherein the appendage is a plurality of metal spring fingers around the body of the mine.

5. The apparatus of claim 1, wherein the means for remotely controlling the assemblies are at least two video cameras disposed on the apparatus and directed toward the assemblies, a portable operator shelter disposed remotely from the assemblies, the operator shelter having at least one display screen for the at least two video cameras, and control means connected to the assemblies.

6. A method for remote disassembly of a failed high explosive type mine, the mine having a body, a safe and arming device, an electronic assembly and a high explosive filler, the body of the mine having an outer portion, an appendage being connected to the outer portion of the body, the method comprising the following steps:

providing a stripper assembly having a tube mounted therein, the tube having a wall, the wall having a circular opening therein, the opening having a diameter to receive therein the body of the mine, a movable cylinder disposed transversely to the tube and opposite the circular opening in the wall of the tube;

inserting a mine in the tube, pressing the mine with the movable cylinder to force the body of the mine through the opening in the wall in the tube, wherein the appendage is stripped from the mine and prevented from passing through the opening in the wall in the tube;

providing a chuck assembly having chuck jaws, the chuck assembly having means to move the chuck jaws from a first position adjacent to the stripper assembly to a second position removed from the stripper assembly and adjacent to a cutter assembly;

receiving the body of the mine from the stripper assembly and mounting it in the chuck jaws while the chuck jaws are in the first position, moving the chuck jaws holding the body of the mine to the second position, rotating the chuck jaws holding the body of the mine;

providing a cutter assembly having a cutter blade thereon;

moving the cutter blade to engage the rotating body of the mine wherein the electronics assembly of the mine is severed from the high explosive in the mine;

providing a puller assembly disposed adjacent to the second position of the chuck assembly, the puller assembly having a jaw means;

stopping the rotation of the chuck jaws in a desired orientation, extending the jaws means of the puller assembly and grasping the safe and arming device by the jaw means of the puller assembly, retracting the jaw means of the puller assembly and removing the safe and arming device from the high explosive in the body of the mine;

providing at least two video cameras disposed on the apparatus and directed toward the assemblies;

providing a portable operator shelter remote from the assemblies, electrical and hydraulic control means in the portable shelter and at least one display screen for the at least two video cameras in the portable shelter wherein the disassembly of the failed high explosive type mine can be performed remotely from the assemblies.

7. An apparatus for remotely disassembling a failed high explosive type mine having a body, a safe and arming device, an electronic assembly and a high explosive filler, the body of the mine having an outer portion and a center inner portion, the apparatus comprising:

a rammer assembly having a frame, a means connected to the frame to firmly retain the outer portion of the body of the mine, a pressing cylinder connected to the frame wherein the pressing cylinder is directed to the center inner portion of the body of the mine, the pressing cylinder being slidably movable within the frame, power means for moving the pressing cylinder against the center inner portion of the body of the mine to force the safe and arming device and the electronic assembly outwardly from the center inner portion of the mine and means for remotely controlling the movement of the pressing cylinder.

8. The apparatus of claim 7, wherein the means for remotely controlling the movement of the pressing cylinder are at least two video cameras disposed thereon and directed toward the rammer assembly, a portable operator shelter disposed remotely from the rammer assembly, the operator shelter having at least one display screen for the at least two video cameras, and control means connected to the rammer assembly.

9. The apparatus of claim 7, further comprising a portable chassis on which the apparatus is mounted.

10. A method for remotely disassembling a failed high explosive type mine, the mine having a body, a safe and arming device, an electronic assembly and a high explosive filler, the body of the mine having an outer portion and a center inner portion, the method comprising the following steps:

providing a rammer assembly having a frame, a means connected to the frame to firmly retain the outer portion of the body of the mine, a pressing cylinder connected to the frame and slidably movable within the frame;

retaining the mine in the means connected to the frame wherein the center inner portion of the body of the mine is oriented toward the pressing cylinder;

moving the pressing cylinder against the center inner portion of the mine wherein the safe and arming device and the electronic assembly is forced outwardly from the mine and separated from the body of the mine and the high explosive filler;

providing at least two video cameras directed toward the rammer assembly;

providing a portable shelter remote from the ran%-met assembly, electrical and hydraulic control means in the portable shelter connected to the rammer assembly and at least one display screen for the at least two video cameras wherein the disassembly of the failed high explosive type mine can be performed remotely from the rammer assembly.

* * * * *